US009625198B2

(12) United States Patent
Dwyer

(10) Patent No.: US 9,625,198 B2
(45) Date of Patent: Apr. 18, 2017

(54) AUTOMATIC ICE VENDING STRUCTURE

(71) Applicant: Ronald Dwyer, Apache Junction, AZ (US)

(72) Inventor: Ronald Dwyer, Apache Junction, AZ (US)

( * ) Notice: Subject to any disclaimer, the term of this patent is extended or adjusted under 35 U.S.C. 154(b) by 864 days.

(21) Appl. No.: 13/784,546

(22) Filed: Mar. 4, 2013

(65) Prior Publication Data

US 2013/0269383 A1 Oct. 17, 2013

Related U.S. Application Data

(60) Provisional application No. 61/606,780, filed on Mar. 5, 2012.

(51) Int. Cl.

| | |
|---|---|
| ***F25C 5/18*** | (2006.01) |
| ***F25C 1/00*** | (2006.01) |
| ***F25C 5/00*** | (2006.01) |
| ***F25C 5/04*** | (2006.01) |
| ***G07F 17/00*** | (2006.01) |

(52) U.S. Cl.

CPC ..... *F25C 1/00* (2013.01); *F25C 5/007* (2013.01); *F25C 5/04* (2013.01); *F25C 5/18* (2013.01); *G07F 17/0071* (2013.01)

(58) Field of Classification Search

CPC .... F25C 1/00; F25C 5/04; F25C 5/007; F25C 5/18

See application file for complete search history.

(56) References Cited

U.S. PATENT DOCUMENTS

| | | | | | |
|---|---|---|---|---|---|
| 4,835,983 | A * | 6/1989 | Chandler, Jr. | F24F 1/022 | 62/261 |
| 5,112,477 | A * | 5/1992 | Hamlin | F25C 5/002 | 222/146.6 |
| 5,437,391 | A * | 8/1995 | Landers | F25C 5/002 | 62/344 |
| 5,474,241 | A * | 12/1995 | Kennedy | B02C 18/18 | 241/100 |
| 5,587,089 | A * | 12/1996 | Vogel | B08B 9/0826 | 210/192 |
| 5,860,564 | A * | 1/1999 | Jablonski | F25C 5/007 | 62/344 |
| 6,093,312 | A * | 7/2000 | Boulter | F25C 5/007 | 62/344 |
| 6,321,802 | B1 * | 11/2001 | Weeks | F25C 5/007 | 141/351 |
| 8,333,223 | B2 * | 12/2012 | Seo | F25C 5/005 | 222/146.6 |
| 2007/0240441 | A1 * | 10/2007 | Hobson | F25C 1/00 | 62/233 |

* cited by examiner

*Primary Examiner* — Orlando E Aviles Bosques
(74) *Attorney, Agent, or Firm* — Robert A. Parsons; Michael W. Goltry; Parsons & Goltry

(57) ABSTRACT

An ice vending structure for making and dispensing ice has an ice maker couplable to a water source. An ice bin is positioned under the ice maker for receiving ice made by the ice maker. A substantially horizontal ice moving auger is positioned in the bottom of the ice bin for ejecting ice out an aperture substantially horizontally, to be received by an ice chute coupled to the aperture. The ice chute directs the ice in a downward and rearward direction into bags supplied by a bag holder assembly.

6 Claims, 9 Drawing Sheets

AUTOMATIC ICE VENDING STRUCTURE

CROSS-REFERENCE TO RELATED APPLICATION

This application claims the benefit of U.S. Provisional Patent Application No. 61/606,780, filed 5 Mar. 2012.

FIELD OF THE INVENTION

This invention relates to ice making and dispensing devices.

More particularly, the present invention relates to vending machines for making and selling ice.

BACKGROUND OF THE INVENTION

In various cultures, ice has become a very important product for individual use. It is used to cool beverages and to keep containers and items carried therein, cool. Most people today have their own ice making capability. However, there is often a need for more ice than one can conveniently produce. Additionally, other people, most notably people working out of doors such as construction workers, yard maintenance workers, road maintenance workers, and the like, often use quantities of ice in large beverage coolers each and every day. The amount of ice used generally requires that it be purchased. Conventionally, this is accomplished by going to a location having a freezer and purchasing prepackaged bags of ice. The ice has been delivered by truck from an ice making location. The cost of this ice can be quite high, having to pay for making the ice, transporting the ice in freezer trucks and storing the ice while waiting to be sold. Each phase also includes numerous people working in the ice making facility, and delivering the ice. All of the people and equipment involved increases the cost of ice. Additionally, all of the movement can result in the ice partially melting and refreezing. This can result in clumping of cubes or ground ice reducing desirability.

Attempts at overcoming these problems have been made by using vending technology. Vending machines are well known and used for collecting money and dispensing goods. These devices have been used to sell ice for many years, overcoming some of the above problems. However, new problems of making, packaging and dispensing ice have arisen. Currently, ice vending devices that make ice are housed in trailer type structures. They include ice making devices which deposit ice in a hopper. Multiple ice moving devices are then employed to position the ice. Currently, ice must be raised to a position well above the hopper thereby providing a substantial vertical drop. This substantial vertical drop is required in current dispensing of ice. To achieve this, multiple ice moving devices are required. One device moves the ice within the hopper to an outlet, a second is positioned under the outlet to move the ice to a third ice moving device. The third ice moving device is used to move the ice upwardly to a dispensing position well above the hopper. This allows gravity to feed ice downward through packaging and delivery. Each of the steps of making, storing, and delivering ice, results in a large footprint. All of the ice moving equipment is expensive, bulky and prone to malfunction. Due to the size of the equipment, one dispensing station is provided on the outside of the structure for customer to purchase ice.

Additionally, when making ice in this manner, the device must be shut down periodically to clean and sanitize. This is expensive and prevents use of the device.

SUMMARY OF THE INVENTION

Briefly, to achieve the desired objects and advantages of the instant invention, provided is an ice vending structure for making and dispensing ice. The ice vending structure includes a substantially horizontally delivered source of ice having an aperture from which ice is ejected. An ice chute is coupled to the aperture and has sidewalls and a front wall terminating in a top and defining a volume therein with an input opening receiving ice from the aperture. A bottom defines a downwardly and rearwardly directed discharge opening, directing the ice ejected from the aperture in a downward and rearward direction. A bag holder assembly is carried below the ice chute structure for holding bags to receive the ice.

In another aspect, an ice vending structure for making and dispensing ice is provided. The ice vending structure includes an insulated building having an interior and an exterior, a delivery port coupling the interior of the building to the exterior of the building and an ice maker positioned within the building and coupled to a water source. An ice bin is positioned under the ice maker for receiving ice made by the ice maker. The ice bin has a bottom, a front end, a rearward end, and an aperture formed through the front end. A substantially horizontal ice moving auger is positioned in the bottom of the ice bin for moving ice in the ice bin toward the front end and ejecting the ice out the aperture. An ice chute is coupled to the aperture, and is carried by the delivery port. The ice chute directs the ice ejected from the aperture from the interior of the building to the exterior of the building in a downward and rearward direction. A bag holder assembly is carried below the ice chute structure for holding bags to receive the ice.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
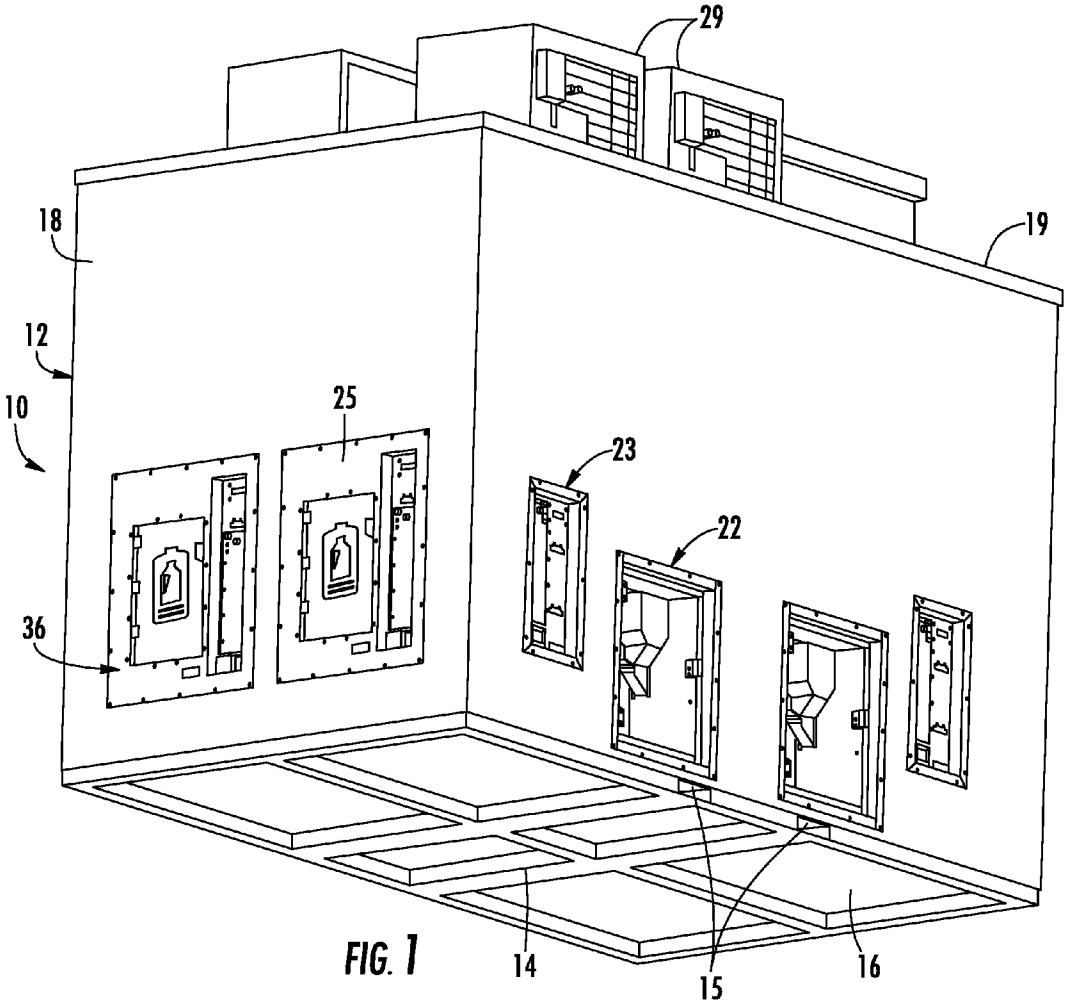
FIG. 1 is a perspective view from an ice vending side of an automatic water and ice vending structure according to the present invention.
Figure 2:
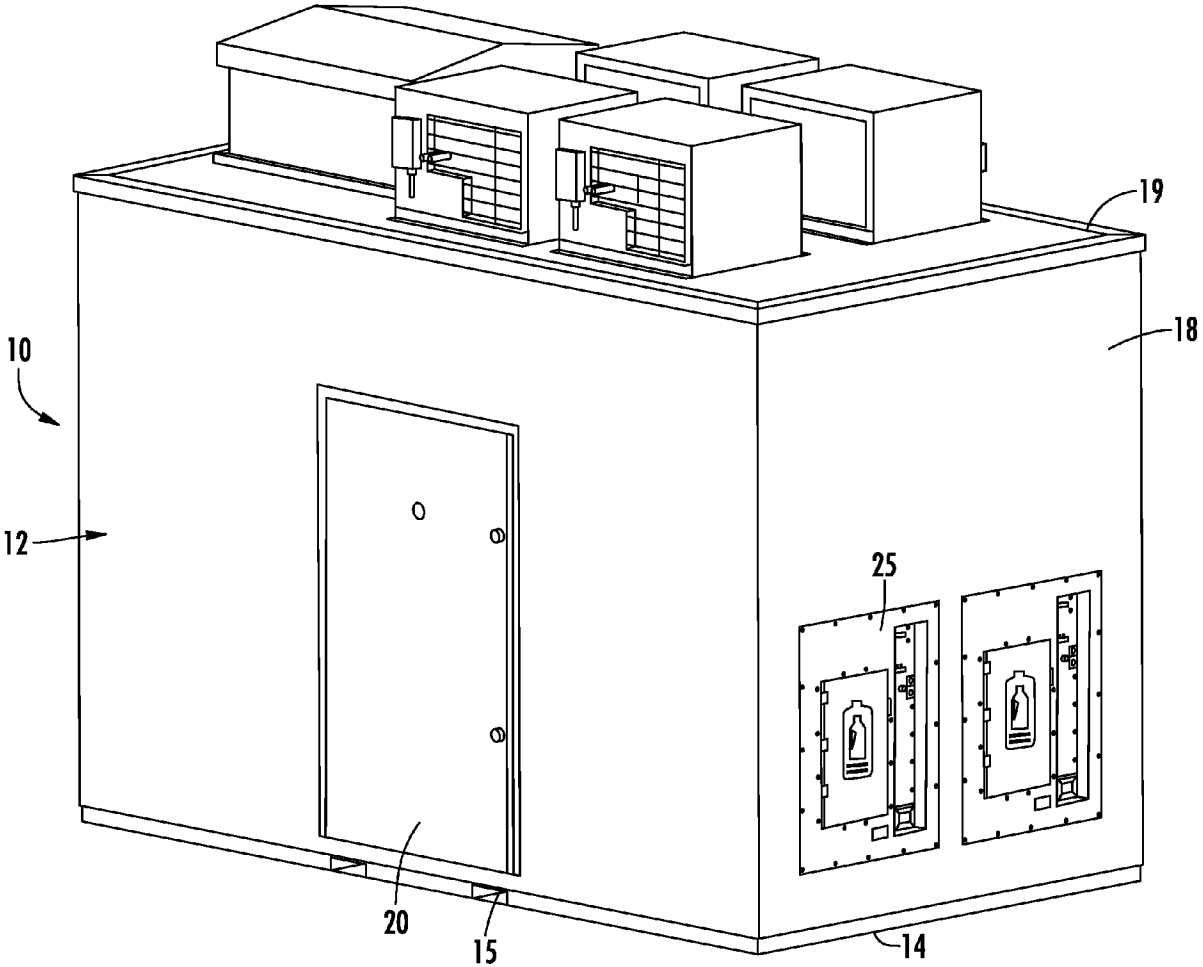
FIG. 2 is a perspective view from a water vending side of an automatic water and ice vending structure according to the present invention.

Turning now to the drawings in which like reference characters indicate corresponding elements throughout the several views, attention is directed to FIGS. 1 and 2 which illustrate an automatic water and ice vending structure, generally designated 10. Structure 10 includes a building 12 supported upon a framework 14 having fork lift apertures 15 therein for ease in lifting, moving and positioning. Building 12 includes a floor 16 carried by framework 14, insulated outer walls 18 extending upward from floor 16 and terminating at a roof 19. Walls 18 are foam injected to insure completely filling the space therein to provide R30 insulation factor. Ingress and egress of building 12 is controlled by a locking security door 20 mounted in one of walls 18. To increase security of building 12, outer walls 18 are preferably sheathed with stainless steel sheeting. Cut-outs are formed in outer walls 18, in communication with an interior of building 12, for receipt of ice vending apparatus 22 with control panel 23 (FIG. 1) and a pair of water vending apparatus 25 (FIG. 2). It will be understood that one or more water vending apparatus 25 and one or more ice vending apparatus 22 can be provided. It should be noted that more than one ice vending apparatus 22 can be provided in a relatively small footprint due to the unique ice delivery system disclosed herein. With reference to FIG. 1, is can be seen that two ice vending apparatus 22 can be positioned side-by-side, separated by less than five feet, and preferably by approximately three feet. Again, the close proximity of each ice vending apparatus is possible due to the unique ice transport system described herein. Ice vending apparatus 22 and water vending apparatus 25 are securely installed in building 12 with edges overlaid by the stainless steel sheeting so as to maintain the security of building 12 and prevent unauthorized access to the interior. The interior of building 12 is cooled by cooling units 29 carried on roof 19, to a level which is preferably close to but above freezing and efficiently maintained at that temperature due to the insulation in the walls of building 12.

Figure 3:
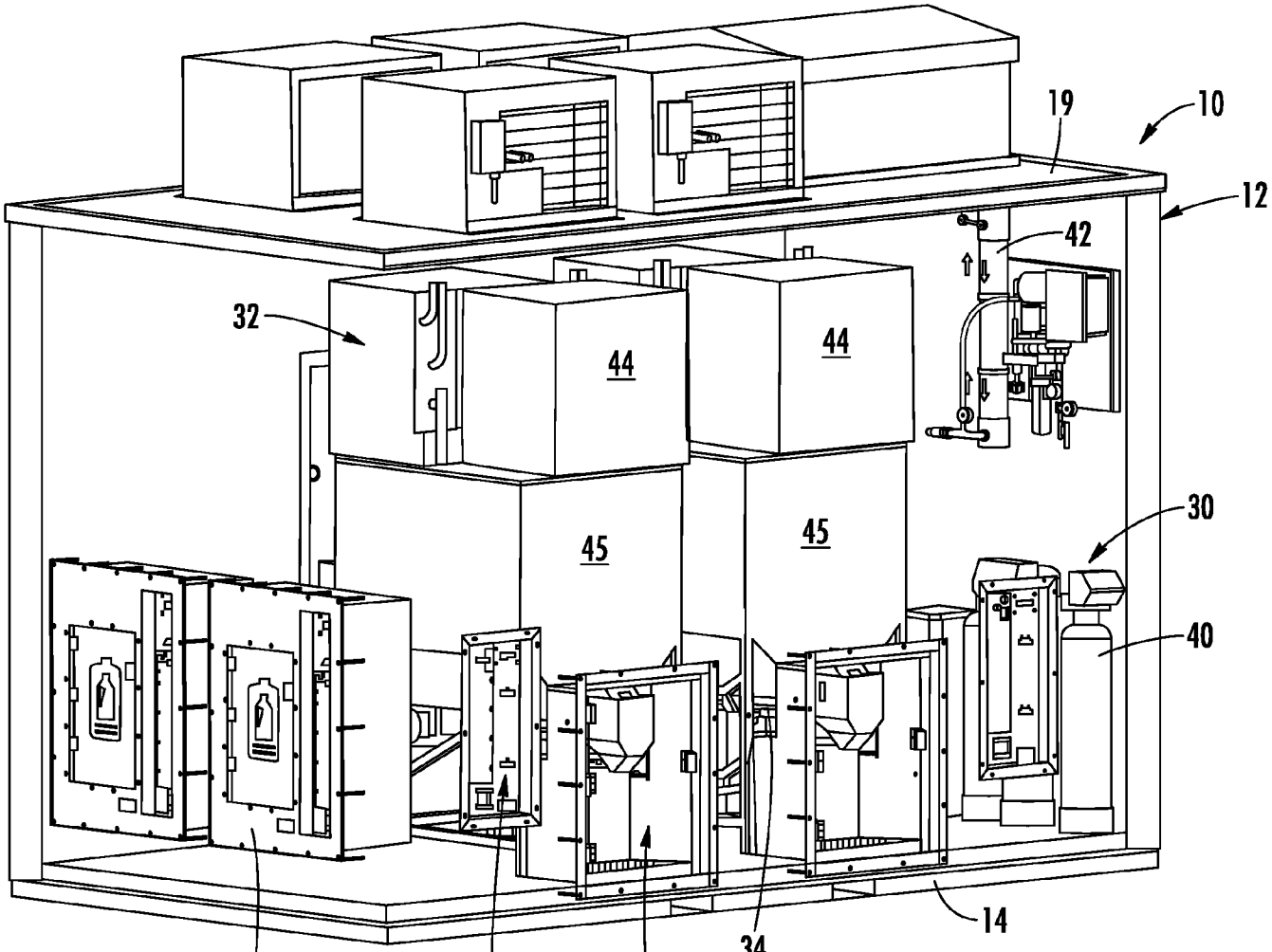
FIG. 3 is a perspective view from an ice vending side of an automatic water and ice vending structure of FIG. 1 with portions of outer walls removed.
Figure 4:
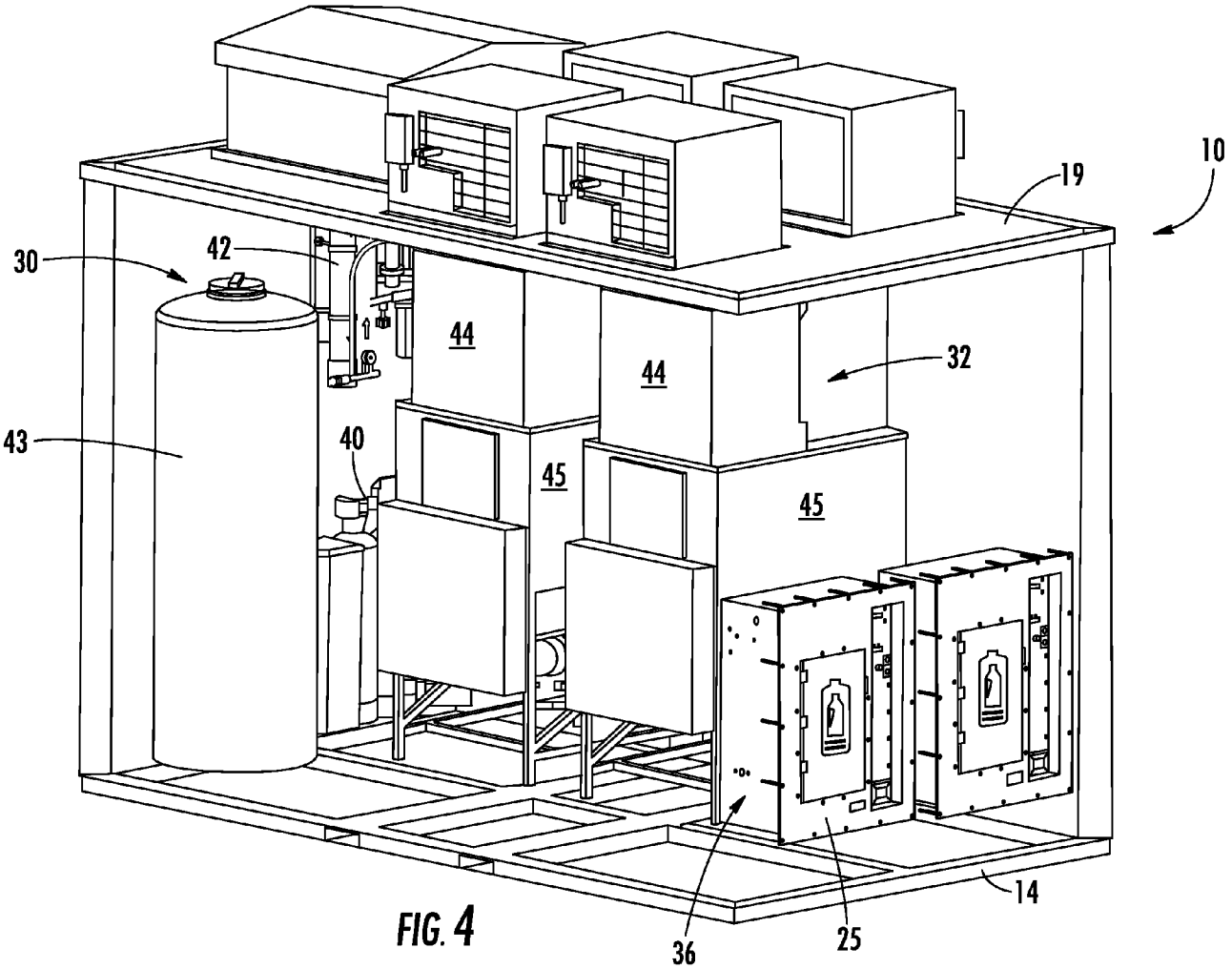
FIG. 4 is a perspective view from a water vending side of an automatic water and ice vending structure of FIG. 2 with portions of outer walls removed.
Figure 5:
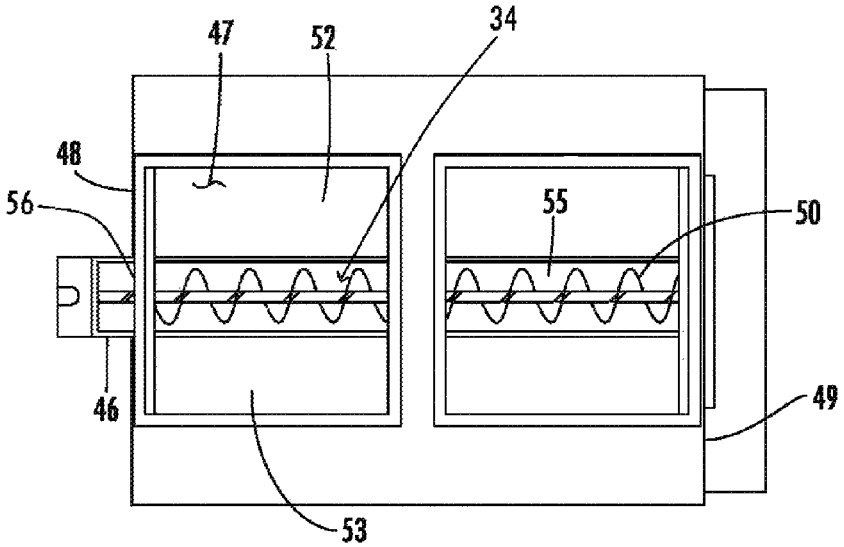
FIG. 5 is a top plan view of an ice bin and ice delivery system.
Figure 6:
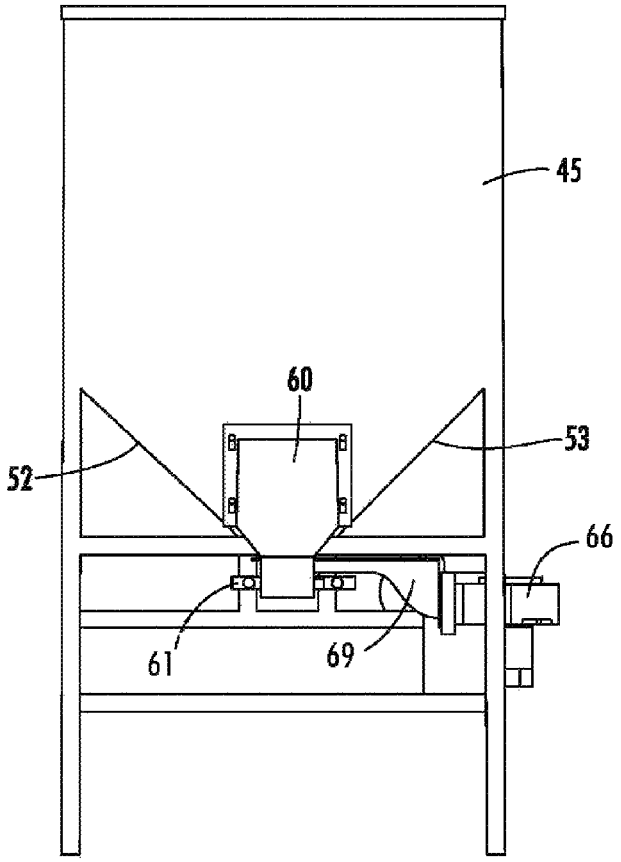
FIG. 6 is a front plan view of the ice bin and ice delivery system.
Figure 8:
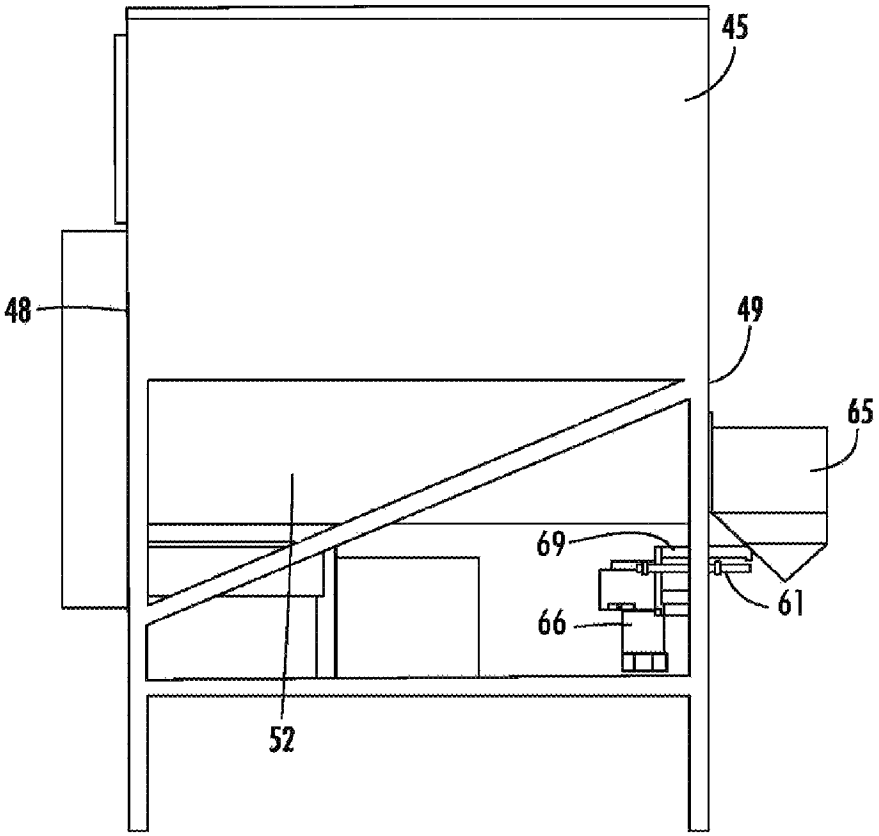
FIG. 8 is a side plan view of the ice bin and ice delivery system.
Figure 7:
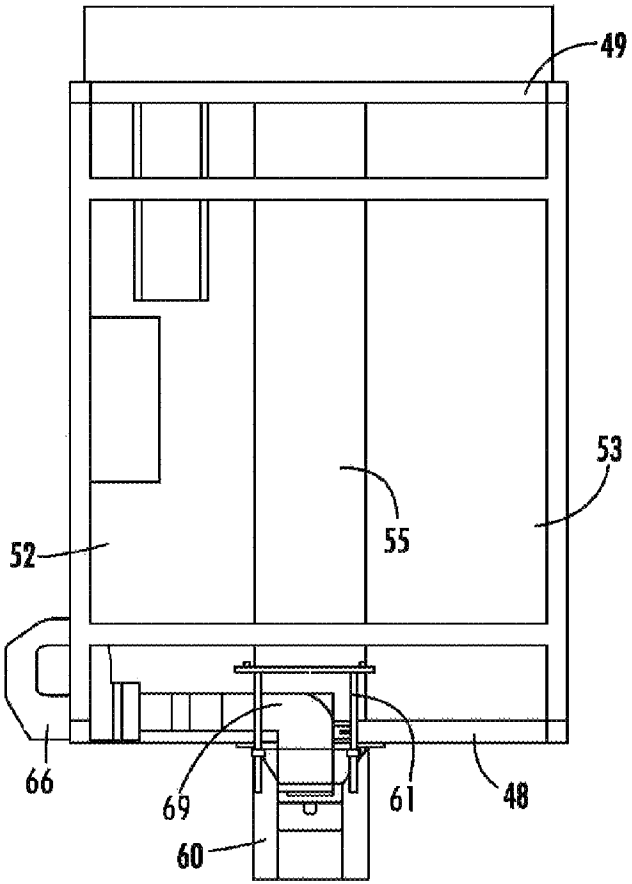
FIG. 7 is a bottom plan view of the ice bin and ice delivery system.
Figure 9:
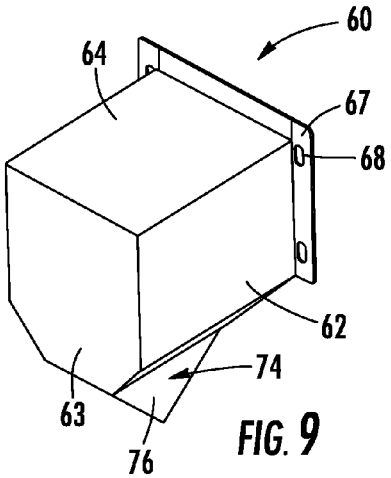
FIG. 9 is a front perspective view of an ice chute structure.
Figure 10:
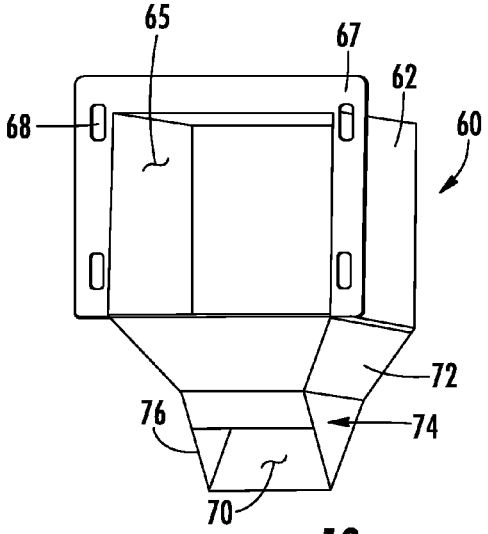
FIG. 10 is a rear perspective view of the ice chute structure.
Figure 11:
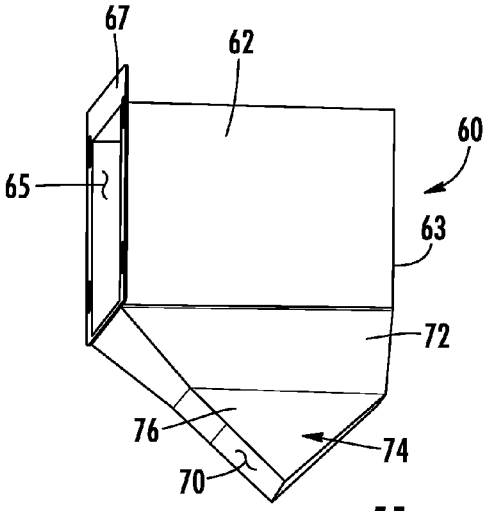
FIG. 11 is a side perspective view of the ice chute structure.
Figure 12:
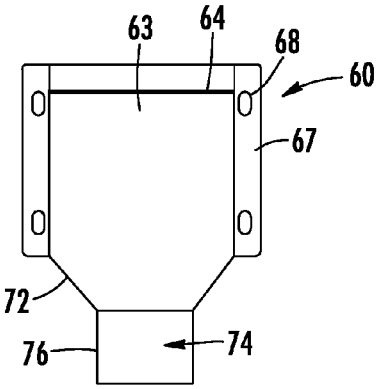
FIG. 12 is a front plan view of the ice chute structure.
Figure 13:
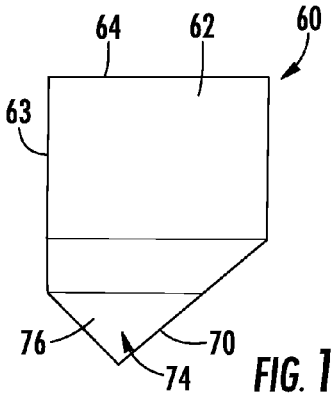
FIG. 13 is a side plan view of the ice chute structure.

Turning now to FIGS. 3 and 4, automatic water and ice vending structure 10 further includes a water treatment system 30, an ice making system 32, an ice delivery system 34 and a water delivery system 36, each carried securely within the interior of building 12 with delivery ports provided by ice vending apparatus 22 and water vending apparatus 25. Water treatment system 30 is provided to remove impurities from the water dispensed and from the water used to make ice. Many systems can be used to achieve this end, but the system preferred in the present invention includes a water softener system 40 receiving water from a water source (not shown) and providing softened water to a reverse osmosis system 42. This water is then stored in a water tank 43 within building 12. Additional purifying devices can be used such as filters, ultra violet light units and the like. Water treatment system 30 further includes an ozonator associated with the reverse osmosis system. The ozonator ozonates the purified water. The processed water (purified and ozonated) is stored in the water tank and cooled by the interior temperature of building 12. The level of water within tank 43 can be maintained by a cap and float assembly. The size of tank 43 should be sufficient to provide the water requirements of water dispensing and ice making. A preferred size is generally from 200-250 gallons with water treatment system 30 capable of processing approximately 3,000 gallons per day.

The use of purified ozonated water for making ice in the present invention, results in a device that requires no periodic cleaning and sanitizing. The ozonated water stored in water tank 43 sanitizes water tank 43. All of the pipes are sanitized by the ozonated water as it is moved through the apparatus. Every time water is added to the ice makers to produce ice, the ice makers are sanitized, eliminating the need for additional sanitization. By using purified water, mineral deposits and other sediments and the like, do not collect on the ice makers. Thus, by using ozonated and purified water, cleaning and sanitizing of the ice making system is eliminated.

Throughout the following description, for purposes of orientation the terms "front", "front end", "forwardly" and "forward end" are intended to designate that end or direction directed outwardly from building 12, while the terms "rear", "rear end", "rearwardly" and "rearward end" are intended to designate that end and direction directed inwardly toward the center of building 12.

Ice making system 32 includes ice makers 44 carried above an ice bin 45. Ice makers 44 are supplied with cold processed water from water tank 43 of water treatment system 30. The pre-cooled water reduces the time and energy required for ice makers 44 to produce ice. While substantially any ice makers can be employed, in the present invention Manitowoc Quiet Cube Ice Machines are preferred with an ice making capacity of 1,800 pounds of ice producible per day. Ice from bin 45 is then delivered to the ice vending apparatus 22 by ice delivery system 34.

With additional reference to FIGS. 5, 6, 7, and 8, ice bin 45 has openings 47 in a top thereof positioned directly under ice makers 44. Ice bin 45 includes a front end 48 and a rearward end 49. Ice delivery system 34 includes an ice moving auger 50 positioned in the bottom of ice bin 45. Sloped bottom sections 52 and 53 of bin 45, funnel ice to a central trough 55 extending from front end 48 to rearward end 49, forming the bottom of ice bin 45. Central trough 55 terminates at an aperture 56 formed through front end 48. Ice collected in ice bin 45 is directed into central trough 55 and into contact with auger 50. Auger 50 extends the length of central trough 55 in a substantially horizontal orientation. When powered, auger 50 moves ice substantially horizontally toward front end 48 and ejecting the ice out aperture 46.

Ice exiting aperture 46 is received and guided by ice chute structure 60. A bag holder assembly 61 is carried below ice chute structure 60. Bags carried by bag holder assembly 61 are opened by air directed by an air duct assembly 69 positioned adjacent ice bag holder assembly 61. Ice from bin 45 is directed by ice chute structure 60 rearwardly and down into a bag supported by bag holder assembly 61. The bag is initially opened to receive ice by air directed by air duct assembly 69 and generated by a blower 66 coupled thereto.

Referring now to FIGS. 9-13, ice chute structure 60 includes sidewalls 62 and a front wall 63 terminating in a top 64 and defining a volume with an input opening 65. Flanges 67 extend perpendicularly outward from sidewalls 62 and have apertures 68 formed therein. With momentary reference to FIG. 6, it can be seen that ice chute is positioned adjacent the front of ice bin 45 using bolts or screws through flanges 67 to secure ice chute 60 in position with input opening 65 aligned with aperture 46. Ice chute 60 further includes a bottom defining a downwardly and rearwardly directed discharge opening 70. The bottom has side sections 72 extending inwardly at a downward angle of approximately 139.56 degrees from sidewalls 62 to funnel ice to a central bottom portion 74. Central bottom portion 74 has vertical sides 76 extending downwardly from side sections 72 and terminating in a ramp 78. Ramp 78 forms the bottom of discharge opening 70 extending rearwardly at a downward angle of approximately 130.2 degrees with respect to front wall 63. It should be noted that ice enters ice chute structure 60 from the side. In other words, a horizontal auger 50 pushed ice horizontally into ice chute structure 60 which then directs the ice in a downward and rearward direction. The angle and direction of ice discharge is important to the successful bagging of ice supplied from a horizontal source.

Figure 14:
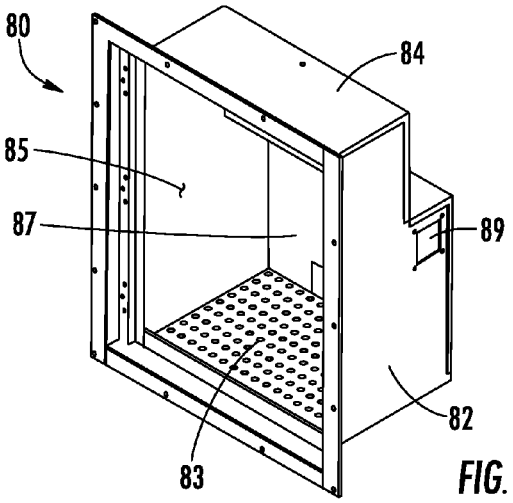
FIG. 14 is a perspective view of a housing of the ice vending apparatus.
Figure 15:
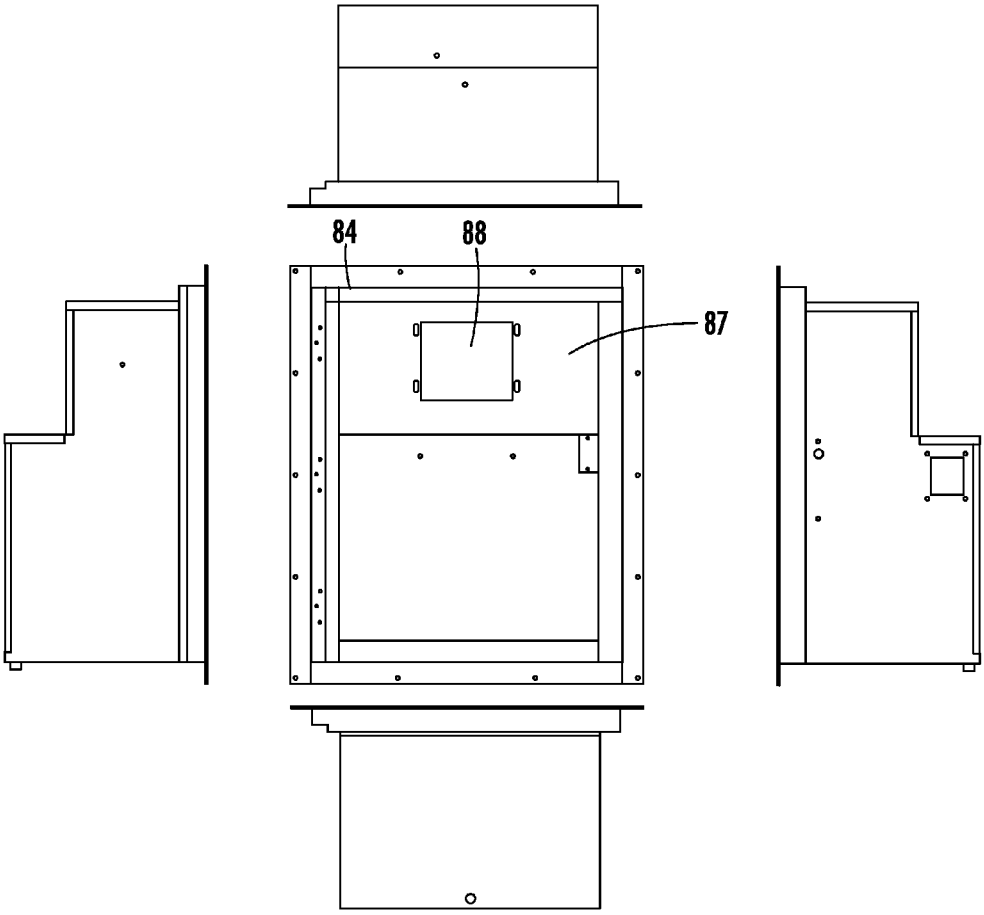
FIG. 15 is a side plan view of a housing of the ice vending apparatus.

As can be seen with reference back to FIG. 1, and to FIGS. 14 and 15, ice vending apparatus 22 includes a housing 80 which fits into a cut-out of building 12 as described previously. Housing 80 includes sidewalls 82 extending upwardly from a bottom 83 and terminating in a top 84 to define an ice receiving volume 85. Housing 80 further includes a back wall 87 having an opening 88 formed therein proximate top 84. Opening 88 is positioned in alignment with aperture 46 of ice bin 45. Ice chute structure 60 is attached to back wall 87 using bolts or screws through flanges 67 to secure ice chute 60 in position with input opening 65 aligned with opening 88 and aperture 46. One of sidewalls 82 includes an opening 89 positioned at a level below opening 88 for purposes which will become clear presently. Ice is delivered and bagged within volume 85 when vending apparatus 22 is actuated. The open front of housing 80 provides customer access to the bagged ice when the proper procedure has been followed. A locking door can be used to close the front of housing 80 until the process has been completed properly. The proper process can include selection of item to be dispensed and insertion of the proper payment using control panel 23. When payment is made, ice is dispensed from ice bin 45 into ice receiving volume 85 where it is received within a bag prior to unlocking the door and allowing access to the bagged ice. The door can be unlocked in a variety of manners such as using solenoids or magnets and the like. Additionally, the ozonator of the water treatment system 30 provides ozone to be flushed through housing 80 periodically, such as every 24 hours. By flushing ozone through housing 80, the inside of the housing, ice chute 60, bag holder assembly 61, etc., everything within housing 80, is sanitized without the need for special attention.

Figure 16:
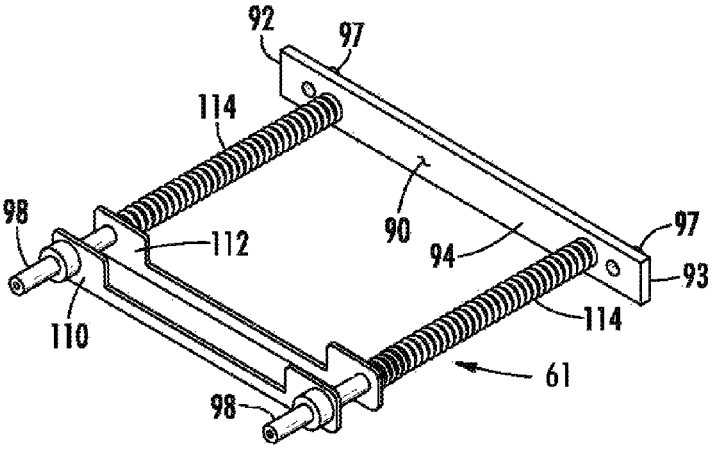
FIG. 16 is a perspective view of a bag holder assembly.
Figure 17:
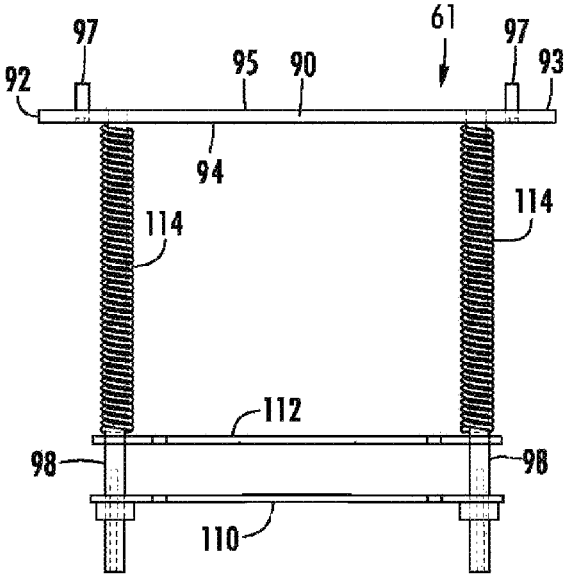
FIG. 17 is a top plan view of the bag holder assembly.

Turning now to FIGS. 16 and 17, ice bag holder assembly 61 includes a mounting plate 90 having opposing ends 92 and 93, a forward surface 94 and a rearward surface 95. A stud 97 extends from rearward surface 95 of mounting plate 90 proximate each of ends 92 and 93. A bag holder rod 98 extends from forward surface 94 of mounting plate 90 proximate each of ends 92 and 93. A stationary plate 110 is fixedly carried by rods 98 and extending therebetween, spaced apart from mounting plate 90. A clamp plate 112 is slidably carried by rods 98 intermediate mounting plate 90 and stationary plate 110. Clamp plate 112 is biased toward stationary plate 110 by springs 114 carried by each rod 98 between clamp plate 112 and mounting plate 90. A stack of bags with aligned edges are carried by rods 98. As each bag is filled and removed, the next in the stack is urged forwardly to be available to receive ice. Studs 97 are received through back wall 87 of housing 80 and securely fastened in place below discharge opening 70 of ice chute 60.

Figure 18:
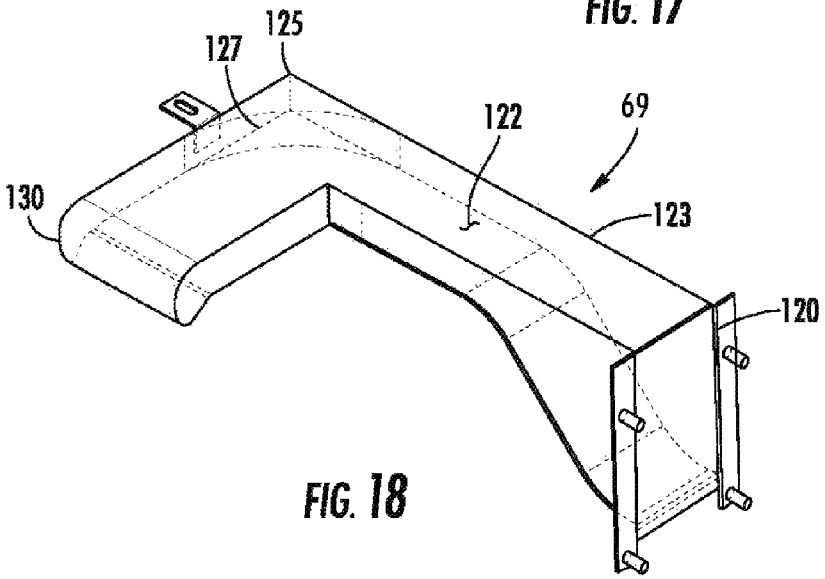
FIG. 18 is a perspective view of an air duct according to the present invention.

As stated previously, a bag carried by bag holder assembly 61 is initially opened by a blast of air directed downwardly and rearwardly at the top open edge of the bag. With reference to FIG. 18, air duct assembly 69 includes a base end 120 coupled to blower 66. Air from blower 66 is directed down a channel 122 formed by sidewalls 123 to a ninety degree bend 125. Channel 122 is positioned substantially parallel to the edge of the bag. is illustrated. At bend 125, a curved deflector 127 is inserted to smoothly redirect the air perpendicularly to the edge of the bag. Duct 69 terminates in a nozzle 130 directing air rearwardly and downwardly across the open top of a bag positioned thereunder. In this manner, a burst of air opens the top of the bag to receive ice from ice chute 60. Once filled, the door is unlocked and a customer can remove and close the bag. The machine is ready for the next purchase.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. An ice vending structure for making and dispensing ice comprising:

an insulated building having an interior and an exterior;

a delivery port coupling the interior of the building to the exterior of the building;

an ice maker positioned within the building and coupled to a water source;

an ice bin positioned under the ice maker for receiving ice made by the ice maker, the ice bin having a bottom, a front end, a rearward end, and an aperture formed through the front end;

a horizontal ice moving auger positioned in the bottom of the ice bin for moving ice in the ice bin toward the front end and ejecting the ice out the aperture;

an ice chute coupled to the aperture, and carried by the delivery port, the ice chute directing the ice ejected from the aperture from the interior of the building to the exterior of the building in a downward and rearward direction, the ice chute including sidewalls and a front wall terminating in a top and defining a volume therein with an input opening for receiving ice from the aperture of the ice bin, and a bottom defining a downwardly and rearwardly directed discharge opening, the bottom includes side sections extending inwardly and downwardly from the sidewalls and terminating in a central bottom portion, the central bottom portion has vertical sides extending downwardly from the side sections and terminating in a ramp extending rearwardly at a downward angle of 130.2 degrees with respect to the front wall and forming the bottom of the discharge opening; and a bag holder assembly carried below the ice chute for holding bags to receive the ice.

2. The ice vending structure as claimed in claim 1 further comprising:

a second delivery port coupling the interior of the building to the exterior of the building, the second delivery port spaced less than five feet from the delivery port;

a second ice maker positioned within the building adjacent the ice maker, and coupled to a water source;

a second ice bin positioned under the second ice maker adjacent the ice maker, for receiving ice made by the second ice maker, the second ice bin having a bottom, a front end, a rearward end, and an aperture formed through the front end;

a second horizontal ice moving auger positioned in the bottom of the second ice bin for moving ice in the second ice bin toward the front end and ejecting the ice out the aperture;

a second ice chute coupled to the aperture, and carried by the second delivery port, the second ice chute directing the ice ejected from the aperture from the interior of the building to the exterior of the building in a downward and rearward direction; and a second bag holder assembly carried below the second ice chute for holding bags to receive the ice.

3. The ice vending structure as claimed in claim 1 further including a water treatment system carried within the building and comprising:

a water softener system receiving water from the water source and providing softened water;

a reverse osmosis system receiving the softened water and providing purified water;

an ozonator receiving the purified water and ozonating the purified water forming processed water; and a water tank storing the processed water.

4. The ice vending structure as claimed in claim 1 wherein the insulated building further comprises:

a framework having fork lift apertures formed in the framework;

a floor carried by the framework;

insulated outer walls extending upward from the floor and terminating at a roof;

a cut-out formed in one of the insulated outer walls in communication with the interior of the building, the delivery port received in the cut-out; and a cooling unit carried on the roof to maintain a temperature in the interior of the building at a level above freezing but below 50 degrees Fahrenheit.

5. The ice vending structure as claimed in claim 4 wherein the building further includes metal sheeting covering outer surfaces of the walls and overlying edges of the delivery port.

6. An ice vending structure for making and dispensing ice comprises:

a horizontally delivered source of ice having an aperture from which ice is ejected;

an ice chute coupled to the aperture and having sidewalls and a front wall terminating in a top and defining a volume therein with an input opening receiving ice from the aperture, and a bottom defining a downwardly and rearwardly directed discharge opening, the bottom includes side sections extending inwardly and downwardly at an angle of 139.56 degrees from the sidewalls and terminating in a central bottom portion, the central bottom portion has vertical sides extending downwardly from the side sections and terminating in a ramp extending rearwardly at a downward angle of 130.2 degrees with respect to the front wall and forming the bottom of the discharge opening, the ice chute directing the ice ejected from the aperture in a downward and rearward direction; and a bag holder assembly carried below the ice chute for holding bags to receive the ice.

* * * * *